United States Patent [19]

Wendt

[11] 4,127,974

[45] Dec. 5, 1978

[54] OUTSIDE CORNER TRIM FOR BUILDING

[75] Inventor: Alan C. Wendt, Barrington, Ill.

[73] Assignee: United States Gypsum Company, Chicago, Ill.

[21] Appl. No.: 794,194

[22] Filed: May 5, 1977

[51] Int. Cl.[2] ..... E04C 2/38

[52] U.S. Cl. ..... 52/288; 52/716

[58] Field of Search ..... 52/288, 287, 716, 614, 52/624

[56] References Cited

U.S. PATENT DOCUMENTS

| | | | |
|---|---|---|---|
| 2,106,260 | 1/1938 | Thumm | 52/716 |
| 2,705,820 | 4/1955 | Torrence | 52/716 X |
| 2,843,889 | 7/1958 | Keller | 52/287 X |
| 2,862,264 | 12/1958 | Perna | 52/288 |
| 3,007,213 | 11/1961 | Hobbs | 52/288 |
| 3,271,919 | 9/1966 | Olton | 52/614 X |
| 3,393,484 | 7/1968 | Dunnington | 52/716 X |
| 3,638,374 | 2/1972 | Harby | 52/288 X |

*Primary Examiner*—Price C. Faw, Jr.
*Assistant Examiner*—Carl D. Friedman
*Attorney, Agent, or Firm*—Glenn W. Ohlson; Samuel Kurlandsky; Robert H. Robinson

[57] ABSTRACT

This invention pertains to an integral one piece corner trim member for an outside corner of a building structure or interior partition wherein the trim piece comprises an extruded section formed from a suitable vinyl material and having an integral barb at the inner side thereof to hold the corner piece in position on the building structure until it is fixedly secured to the building walls.

1 Claim, 2 Drawing Figures

OUTSIDE CORNER TRIM FOR BUILDING

BACKGROUND OF THE INVENTION

Heretofore, corner pieces for use in building construction, or for the assembly of partitions or the like, were either fabricated at the erection site from available materials or comprised prefabricated members which were manually held in place while being assembled with the structure and secured in fixed relation to the building structure. Corner pieces of sheet metal have been utilized to provide a closure at such positions and metal angle sections, or other formations, have been used to frame a corner, but with these prior arrangements it has been necessary physically to maintain such members in proper relation to the supporting structure while the member was being secured. Such practices were time consuming and frequently difficult and consequently expensive from the standpoint of labor and the man hours involved in completing structures of this type.

SUMMARY OF THE INVENTION

This invention provides a one piece corner trim member especially designed for use on outside corners of building structures, or partitions. The corner piece comprises an extrusion in its preferred form and is formed from a suitable plastic material such as a rigid vinyl. The extruded section is cut to length as required or designed for specific installations. The extrusion is formed to include an integral barb at an inner side which acts as a holding member for retaining the corner piece in proper position while it is being secured in place. The barb is integral with an inwardly extending web, or flange and is adapted to enter between the opposed surfaces of an opening provided in a building or partition structure into which it is driven, or pushed, in order to hold the corner piece in place by the gripping action of the opposed surfaces thereon until the corner member is fixedly adhered to the structure. The corner piece can be fixed to the building structure by a suitable mastic placed on the inside walls of the corner piece whereby when the attaching barb is pushed, or forced into the retaining opening, the mastic will be brought into contact between the building corner and the inner surfaces of the corner piece so that the trim piece will thereby be cemented in place and held against displacement.

OBJECT OF THE INVENTION

It is the primary purpose of this invention to provide a corner trim piece for outside corners of buildings, or partitions, having an integral member engageable with the building structure to hold the trim piece in position until it is adhered to the building.

The principal object of the invention is the provision of a corner trim piece of one piece construction having a member for holding the trim piece in position while being adhered.

An important object of the invention is to provide a corner trim piece having an integral barb projecting from an inner side to engage an opening provided in the building to hold the corner trim piece in proper relation to the building corner.

Another object of the invention is the provision of a corner trim piece formed as an extruded section having an integral barb on an inward side thereof for engaging a structure to hold the corner piece in place.

A further object of the invention is to provide a corner trim piece formed as an extrusion from a plastic material such as rigid vinyl having an integral retaining barb on an inner side and provided with one or more inside pockets for a mastic adapted to adhere the corner piece to a supporting structure.

DESCRIPTION OF THE DRAWINGS

The foregoing and other and more specific objects of the invention are attained by the construction and arrangement illustrated in the accompanying drawings wherein.

DESCRIPTION OF THE PREFERRED EMBODIMENT

Figure 1:
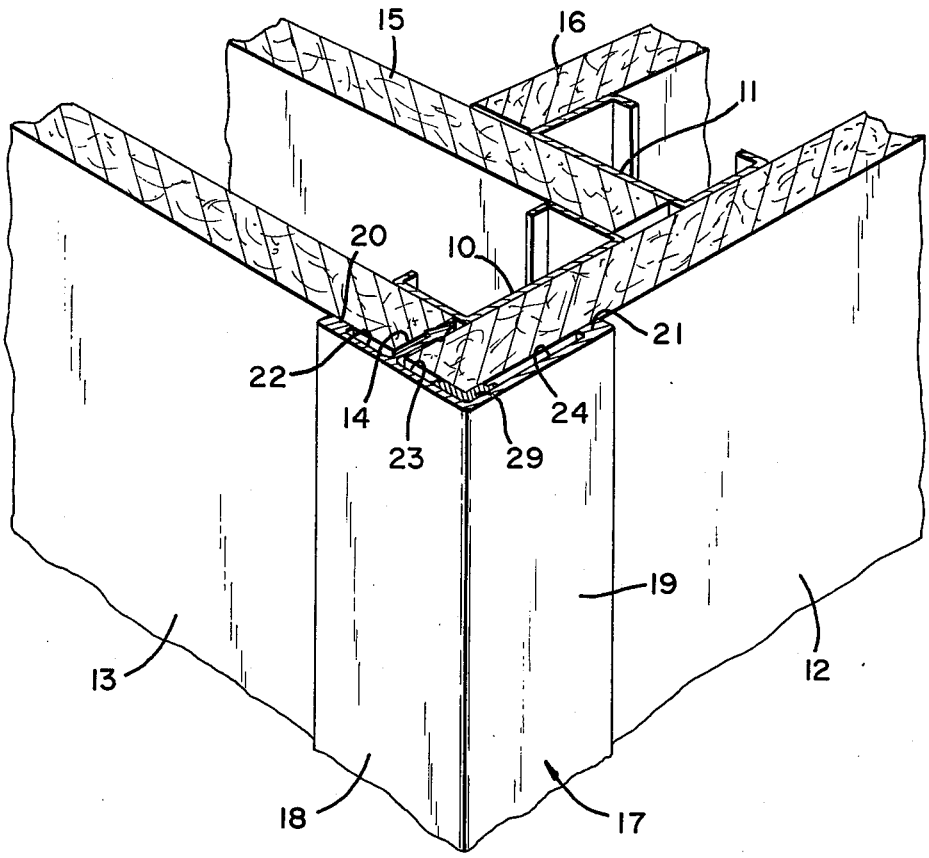
FIG. 1 is a general perspective view of a portion of a building structure at a corner thereof with parts illustrated in section and showing the one piece corner time piece of this invention adhered in place about the building corner.
Figure 2:
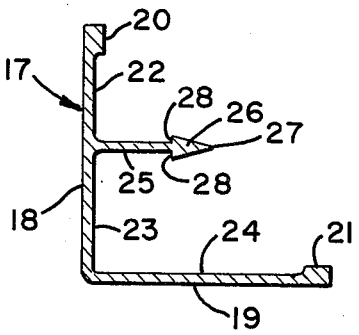
FIG. 2 is a detail cross-sectional view through the corner piece clearly illustrating the integral barb forming the prime element of this invention.

In the drawings, as shown in FIG. 1, the structure of a building is illustrated as typically utilized adjacent an outside corner thereof and includes vertical framing elements 10 and 11 which, as disclosed here, comprise metallic sections of open channel shaped configuration to which outside walls 12 and 13 are secured. As indicated, the wall 12 extends beyond the framing member 10 adjacent to the corner and the edge of the wall member 13 is spaced somewhat from the projecting portion of the wall member 12 to provide an opening 14 therebetween for a purpose hereinafter to appear. An inner wall member 15 is spaced from the outside wall member 13 and extends between the framing members 10 and 11 with the framing member 10 disposed between the outer and inner walls 13 and 15. An inner wall 16 is butted edgewise against the inside face of the wall member 15 and bears against the inner face of the framing member 11. All of the wall forming members 12, 13, 15 and 16 are secured to the framing members 10 and 11 in any manner preferred to provide a securely rigid structure.

A corner trim piece 17 is utilized to give the outside corner of the building structure a completely weatherproof closure and a finished appearance. This corner piece comprises an extrusion which is extruded from a plastic material such as a rigid vinyl and the material may include a coloring ingredient if desired. The rim piece 17 is formed with flanges 18 and 19 extending generally at right angles to each other and at the extremities, or free edge of each flange a thickened, or bulb portion 20 and 21 on the respective flanges is formed integrally with the flanges. This creates pockets 22 and 23 on the inner side of the flange 18 and pocket 24 on the inner surface of the flange 19. These pockets have the effect of providing a space between the flanges 18 and 19 of the corner piece and the respective outside wall members 13 and 12, as represented by the thickness of the bulb portions 20 and 21 and insure a tight engagement of the thickened bulb portions with the respective building walls.

The corner piece flange 18 is provided with an inwardly projecting flange 25 which terminates at its inner end in a barb 26. The barb 26 tapers to a point 27 at its forward end and has relatively sharp shoulders 28 at its rear portion projecting laterally from respectively opposite sides of the flange 25. When the corner trim piece 17 is assembled onto the corner of the building wall the barb member 26 is pushed, or forced into the opening 14 between the edge of wall member 13 and the adjacent inside face of wall member 12. The point 26 of the barb readily enters the space between the wall members and the tapered surfaces of the barb enable the wider shoulder portions 28 to be forced into the cavity under pressure and the resistance, or force of the engagement of the wall portions on the opposing shoulders of the barb serves to hold the barb against withdrawal and thus retains the corner piece in proper position on the corner until it is finally adhered to building structure. The corner piece may be secured to the building structure in any preferred manner but as shown in FIG. 1 the herein disclosed method of adhering the trim piece to the corner of the building is by means of a mastic 29 placed in the inner pockets 23 and 24 of the corner piece so that when the member is pressed onto the building corner this cement will come in contact with the corner of the building and spread along both sides of the corner to provide a secure attachment between the inner surfaces of the corner piece and both sides of the building corner.

The invention has been disclosed as applied with a typical partition corner of conventional gypsum wallboard and metal stud construction, but the invention can just as well be used with other types of interior and exterior wall structures such as with wood paneling, aluminum siding, wood siding or vinyl siding. The invention can be used with practically any type of building or partition structure where a corner trim piece of this type may be required to close or complete a corner installation and provide a weatherproof finished appearance for the building corner. The embodiment disclosed is presently considered to be the preferred form of the invention but changes or modifications may be made differing from this disclosure and it is intended that the claims appended to this specification shall cover all such changes or modifications as may fall within the purview of this invention.

What is claimed is:

1. An outside corner trim piece of integral one piece construction, said piece comprising an extrusion and is extruded from a plastic material such as rigid vinyl and having a pair of flanges of substantially equal length disposed substantially at right angles to each other, a bulb edge on each said flange defining the depth of at least one pocket on the inner side of each flange, a flange projecting inwardly at substantially right angles from one of said first-named flanges, and a pointed barb on the free end of the inwardly projecting flange having sharp shoulders projecting up on opposite sides of the last-named flange said pointed barb of said inwardly projecting flange entering an opening betweeen an edge of a wall member and an adjacent inside face of an adjacent wall member at an outside building corner and said sharp shoulders holding the barb against withdrawal to retain the corner trim piece in position, and wherein said corner trim piece includes mastic cement in said pockets adhering said corner trim piece to the supporting outside building corner surface.

* * * * *